US006790048B2

(12) United States Patent
Goodwin et al.

(10) Patent No.: US 6,790,048 B2
(45) Date of Patent: Sep. 14, 2004

(54) BOARD-TO-BOARD FLEX CONNECTOR

(75) Inventors: Jonathan Goodwin, Braintree, MA (US); Donald Amaral, Jr., Seekonk, MA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/128,398

(22) Filed: Apr. 23, 2002

(65) Prior Publication Data

US 2003/0199178 A1 Oct. 23, 2003

(51) Int. Cl.[7] ..... H01R 12/00
(52) U.S. Cl. ..... 439/65; 439/331; 439/67
(58) Field of Search ..... 439/65, 74, 66, 439/591, 67, 492, 493, 73, 91, 331, 700

(56) References Cited

U.S. PATENT DOCUMENTS 4,482,937 A * 11/1984 Berg ..... 361/789
4,528,500 A * 7/1985 Lightbody et al. ..... 324/537
5,026,291 A * 6/1991 David ..... 439/67
5,388,998 A * 2/1995 Grange et al. ..... 439/66
5,479,110 A * 12/1995 Crane et al. ..... 324/757
6,227,871 B1 * 5/2001 Bender ..... 439/67
6,358,064 B2 * 3/2002 Szalay et al. ..... 439/67
6,386,890 B1 * 5/2002 Bhatt et al. ..... 439/67
6,426,878 B2 * 7/2002 Tanioka et al. ..... 361/760

OTHER PUBLICATIONS

Portions of Intercon Systems website (www.interconsystems.com).

* cited by examiner

*Primary Examiner*—P. Austin Bradley
*Assistant Examiner*—Edwin A. Leon

(57) ABSTRACT

A flex connector assembly for connecting circuit boards has been provided that includes a housing having at least one cavity holding a preloaded spring exerting an outwardly-directed force toward top and bottom ends of the housing; at least one pressure support member located at one of the top and bottom ends, the pressure support member exerting an inwardly-directed force on the preloaded spring; and at least one flex circuit having a flex array arranged on one of the top and bottom ends; and at least one compressible socket having a socket array overlapping the flex circuit. The preloaded spring acts to compress the flex array and the socket array onto one another.

27 Claims, 7 Drawing Sheets

BOARD-TO-BOARD FLEX CONNECTOR

BACKGROUND OF THE INVENTION

Certain embodiments of the present invention generally relate to a connector for electronic equipment, and more particularly to a flex connector assembly that connects printed circuit boards.

Various electronic systems, such as computers, comprise a wide array of components mounted on printed circuit boards, such as daughterboards and motherboards, which are interconnected to transfer signals and power throughout the systems. The transfer of signals and power between the circuit boards requires electrical connectors between the circuit boards. Flexible circuits, or flex circuits, are used with various electronic and electrical devices. In many applications, flex circuits are used in conjunction with rigid circuit boards, such as printed circuit boards. Because flex circuits and rigid circuits are often used together, connectors are used to electrically connect the flex circuits to the rigid circuits.

As two printed circuit boards are connected by way of a connector, there needs to be enough clearance between the two printed circuit boards to accommodate for the components positioned between the circuit boards. For example, the components between two circuit boards cannot be larger than the corresponding gap between the two printed circuit boards, as dictated by the connector that connects the two printed circuit boards.

Current microprocessors and associated integrated circuits typically require higher levels of power as compared to previous microprocessors and integrated circuits. Along with higher power requirements, current microprocessors typically draw higher currents. For example, many microprocessors require approximately 100 amps of current to function properly. Additionally, modern microprocessors switch currents at very fast rates, such as from 0 amps to 100 amps in 1 microsecond or less. Overall, because modern microprocessors operate at high speeds, they typically require greater amounts of power than previously required. Larger and more powerful components are being produced to accommodate the ever-increasing frequency and power requirements of current systems. However, current board-to-board connectors are incapable of connecting printed circuit boards having these components because the connectors do not allow for enough clearance between the printed circuit boards while maintaining a reasonably high frequency transmission.

Thus a need exists for a board-to-board connector that is capable of connecting printed circuit boards with sufficient clearance between the printed circuit boards.

BRIEF SUMMARY OF THE INVENTION

In accordance with at least one embodiment of the present invention, a flex connector assembly has been developed that includes a housing, first and second pressure support members, first and second compressible sockets, and at least one flex circuit. The housing has at least one cavity, which holds a preloaded spring that exerts an outwardly-directed force from first and second ends of said housing. The first pressure support member is located on the first end of the housing, while the second pressure support member is located on the second end of the housing. The first and second pressure support members are mounted on the first and second ends resisting the outwardly-directed force exerted by the preloaded spring(s). The first and second compressible sockets are arranged proximate the first and second ends. The first compressible socket has a first socket array and the second compressible socket has a second socket array.

Each flex circuit has a main body, a first flex array located at one end of the main body and a second flex array located at another end of the main body. The first and second flex arrays are electrically connected through traces located on the flex circuit. The outwardly-directed force compresses the first flex array into the first socket array to form an electrical path therebetween. The outwardly-directed force compresses the second flex array into the second socket array to form an electrical path therebetween. The first socket array is configured to be compressed into contacts on a first circuit board, and the second socket array is configured to be compressed into contacts on a second printed circuit board.

Figure 1:
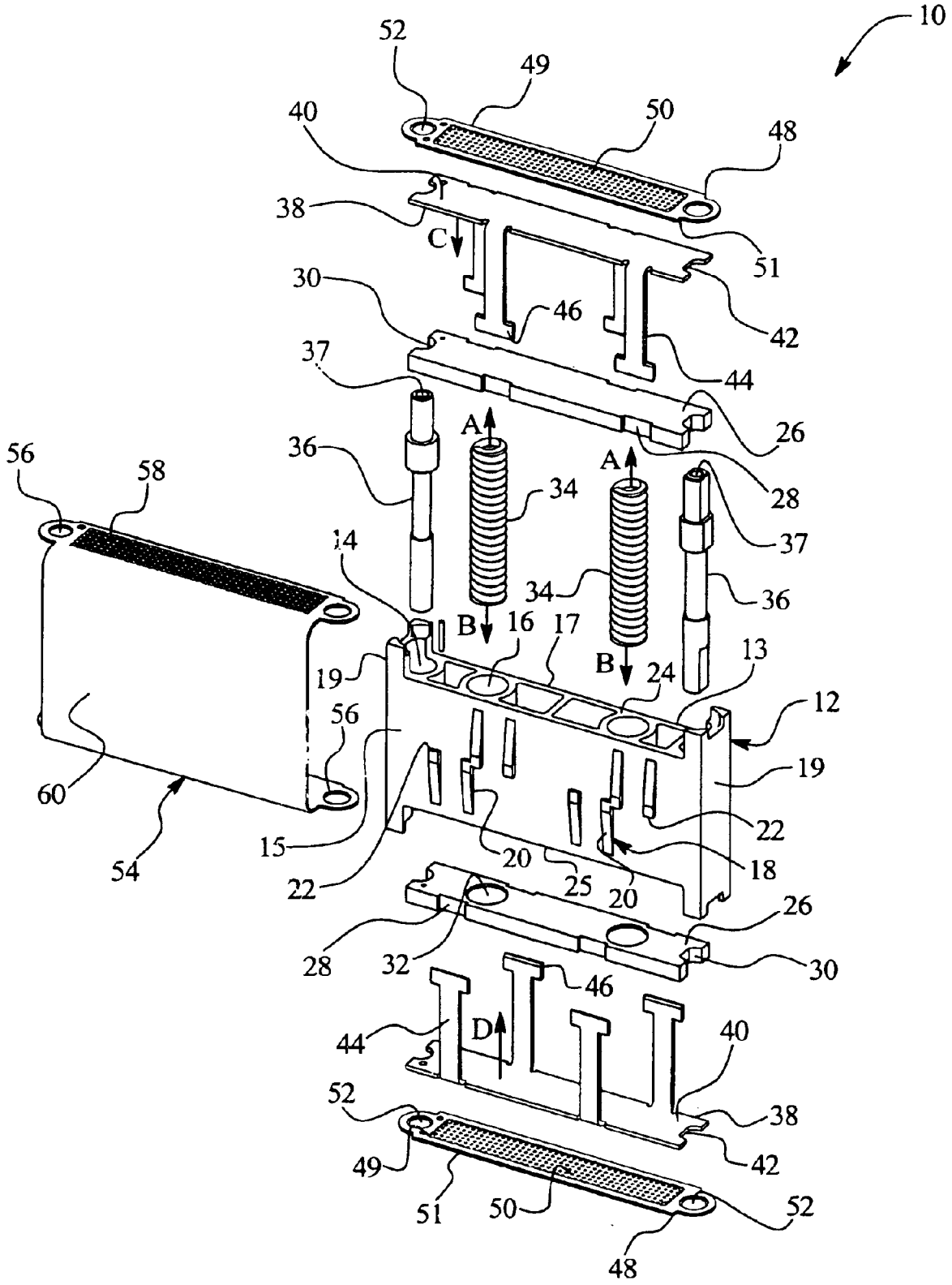
FIG. 1 illustrates an exploded view of a flex connector assembly formed in accordance with an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 illustrates an exploded view of a flex connector assembly 10 formed in accordance with an embodiment of the present invention. The flex connector assembly 10 includes a housing 12, pressure plates 26, springs 34, location pins 36, support plates 38, compressible sockets 48 and a flex circuit 54. The housing 12 includes pin cavities 14, spring cavities 16, support leg retaining ramps 18, and pressure plate recesses 24 formed within top and bottom surfaces of the housing 12. The pin cavities 14 extend from a top surface 13 of the housing 12 to a bottom surface 25. Similarly, each spring cavity 16 extends from the top surface 13 to the bottom surface 25. FIG. 1 shows two spring cavities 16 and two pin cavities 14; however, more or less than two spring and pin cavities 16 and 14 (and consequently springs 34 and location pins 36) may be included within the housing 12. The support leg retaining ramps 18 are formed on a front surface 15 and a back surface 17 of the housing 12. The support leg retaining ramps 18 include ramped surfaces 20 and retaining edges 22. That is, each ramped surface 20 terminates at a retaining edge 22.

Each pressure plate 26 includes support leg notches 28, location pin divots 30 and spring retention recesses 32. Each support leg notch 28 aligns with a pair of complimentary support leg retaining ramps 18 in order to retain a support leg 44 of the support plate 38. That is, upon assembly of the flex connector assembly 10, as discussed below, a support leg 44 of the support plate 38 is retained by a pair of support leg retaining ramps 18 and a support leg notch 28. Further, each location pin divot 30 is formed to align with a corresponding pin cavity 14 formed within the housing 12. Additionally, each spring retention recess 32 is formed to align with a corresponding spring cavity 16 formed within the housing 12.

Each location pin 36 includes fastener retention cavities 37 formed within terminal ends of the location pin 36. As discussed below, each location pin 36 is placed within a pin cavity 14, which retains the location pin 36 in conjunction with complimentary structures on the pressure plate (location pin divot 30), the support plate 38 (location pin divot 42), the compressible socket 48 (location pin retention cavity 52) and the flex circuit 54 (location pin retention cavity 56). Similarly, each spring 34 is placed within a spring cavity 16, which retains the spring 34 in conjunction with the spring retention recess 32 of the pressure plate 26. Each spring 34 has a particular spring tension, depending on the desired amount of pressure to be exerted within the flex connector assembly 10. That is, each flex connector assembly 10 is pre-loaded depending on the desired amount of compressibility between the compressible sockets 48 and the flex circuit 54.

Each support plate 38 includes a main body 40, location pin divots 42, support legs 44 extending from the main body 44 and retaining edge engagement members 46, each of which are formed as a terminal end of a support leg 44. The retaining edge engagement members 46 are formed to engage the retaining edges 22 of the support leg retaining ramps 18. Thus, the retaining edge engagement members 46 may be any shape that is capable of being retained by the retaining edges 22. The location pin divots 42 are formed to align with the location pin divots 30 of the pressure plate 26. The pressure plate 26 and the support plate 38 may be formed of a metal, such as steel, or plastic. As shown in FIG. 1, the pressure plate 26 and the support plate 38 are distinct and separate components. Optionally, however, the pressure plate 26 and the support plate 38 can be formed integrally with one another. Also optionally, the support plate 38 may include more or less support legs 44 than shown in FIG. 1. For example, instead of four support legs 44, two of which contact the front surface 15 of the housing and two of which contact the back surface 17 of the housing, two support legs 44 may be used. For example, one support leg 44 may contact the front surface 15 while the other support leg 44 may contact the back surface 17. Alternatively, one support leg 44 may contact a lateral surface 19 of the housing 12 while the other support leg 44 may contact the other lateral surface 19 of the housing 12.

Each compressible socket 48 includes a conductive array 50, such as conductive buttons, and location pin retention cavities 52. The location pin retention cavities 52 are formed to align with the pin cavities 14 of the housing 12. The conductive array 50 includes conductive elements that extend from a top surface 49 to a bottom surface 51 of the compressible socket 48, such that an electrical connection may be established from an abutting printed circuit board (discussed below) to the flex circuit 54.

The flex circuit 54 includes location pin retention cavities 56, conductive arrays 58 (located at opposite ends of the flex circuit), such as conductive buttons, and a main body 60. The flex circuit 54 is formed such that each conductive array 58 aligns with a corresponding conductive array of a compressible socket 48, while the main body 60 of the flex circuit 54 may cover, among other components, the front surface 15 (or the back surface 17) of the housing 12. The location pin cavities 56 are formed to align with the pin cavities 14 of the housing 12. The conductive array 58 includes conductive elements that connect with internal and external traces (not shown) formed on and within the flex circuit 54. The traces connect conductive elements on a first conductive array 58 of the flex circuit to conductive elements on a second conductive array 58 of the flex circuit 54. Thus, an electrical connection may be established from one conductive array 58 of the flex circuit 54, to the other conductive array 58 of the flex circuit 54.

In order to assemble the flex connector assembly 10, the springs 34 are positioned within the spring cavities 16 of the housing 12. As mentioned above, each spring 34 has a particular spring tension depending on the desired amount of compressibility between the conductive arrays 58 on the flex circuits 54 with the conductive arrays 50 on the compressible sockets 48. Additionally, the location pins 36 are positioned within the pin cavities 14 of the housing 12. Once the springs 34 and the location pins 36 are positioned within the housing 12, the pressure plates 26 are placed within the pressure plate recesses 24 of the housing 12. That is, one pressure plate 26 is positioned within one pressure plate recess 24 while another pressure plate 26 is positioned within the other pressure plate recess 24. As the pressure plates 26 are positioned within the pressure plate recesses 24, terminal ends of each spring 34 are positioned within the spring retention recesses 32 of the pressure plate 26, while the location pins 36 extend through the location pin divots 30. Each terminal end of each spring 34 is positioned within a spring retention recess 32 and abuts against the pressure plate 26. That is, the springs 34 do not extend through the pressure plates 26. Alternatively, however, the springs 34 may extend through the pressure plates 26 and abut against the main bodies 40 of the support plates 38.

After the pressure plates 26 are positioned within the pressure plate recesses 24, the A support plates 38 are positioned over the pressure plates 26. Each support leg 44 of each support plate 38 is positioned within a support leg notch 28 as the retaining edge engagement member 46 of each support leg 44 is slid over the ramped surfaces 20 of two support leg retaining ramps 18. As shown in FIG. 1, two complimentary support leg ramps 18 form a retaining feature for a support leg 44. As a support leg 44 is slid over the ramped surfaces 20, the support leg is retained by the complimentary support leg ramps 18 when the retaining edge engagement member 46 advances past the retaining edges 22 and hooks the retaining edges 22. Thus, as the support legs 44 of one support plate 38 hook, snap into place, or are otherwise retained by, support leg retaining ramps 18, the support plate 38, through the retention of the retaining edge engagement member 46 by the support leg retaining ramps 18, exerts a force toward the housing 12, while the springs 34 exert a force into the pressure plate 26, which in turn exerts a force into the support plate 38. As support legs 44 of both support plates 38 are retained by the support leg retaining ramps, each spring 34 exerts pressure in the direction of reference line A (into the top support plate 38), while simultaneously exerting a pressure in the direction of reference line B (into the bottom support plate 38). Also, as the springs 34 exert pressure into the support plates 38, the support plates 38 exert pressure toward the housing 12. That is, the top support plate 38 exerts a force, denoted by reference line C, toward the housing 12, while the bottom support plate 38 exerts a force, denoted by reference line D, toward the housing 12. In other words, the support plates 38 resist the forces exerted by the spring 34. The forces, or pressures, exerted by the springs 34 and the support plates 38 provide a static relationship within the flex connector assembly 10. That is, the force exerted in the direction of reference line A is equal, but opposite, to the force exerted in the direction of reference line C. Similarly, the force exerted in the direction of reference line B is equal, but opposite, to the force exerted in the direction of reference line D. When the flex connector assembly 10 is fastened to two printed circuit boards (as described below), the outwardly exerted forces, denoted by reference lines A and B, provide compressive force between the conductive arrays 50 and the conductive array 58.

Once the support plates 38 are positioned within the flex connector assembly 10, the flex circuit 54 is positioned within the flex connector assembly 10. The flex circuit 54 is positioned such that the location pin retention cavities 56 are positioned around, and retain, the location pins 36, which extend from the location pin divots 42 of the support plates 38. Thus, as shown in FIG. 1, the top support plate 38 is positioned under a conductive array 58, while the bottom support plate 38 is positioned above another conductive array 58 of the flex circuit 54 (although it is to be understood that the orientation of the flex connector assembly 10 may be shifted longitudinally or laterally such that, for example, the bottom support plate 38 is positioned under another conductive array 58). The two conductive arrays 58 are electrically connected through traces formed on and within the main body 60, which wraps around the housing 12, the pressure plates 26 and the support plates 38. After the flex circuit 54 is positioned on the flex connector assembly 10, one compressible socket 48 is positioned over one conductive array 58 of the flex circuit 54, while another compressible socket 48 is positioned under another conductive array 58 of the flex circuit 54. The conductive arrays 58 of the flex circuit contact the conductive arrays 50 of the compressible sockets 48. Additionally, the location pin retention cavities 52 of the compressible sockets 48 align the compressible sockets 48 in relation to the flex circuit 54. The retention pin cavities 52 and the location pins 36 may be formed such that an interference fit is formed between the retention pin cavities 52 and the location pins 36. Thus, the retention pin cavities 52 may retain the location pins 36 such that the compressible sockets 48 are retained by the retention of the location pins 36 by the retention pin cavities 52.

Figure 2:
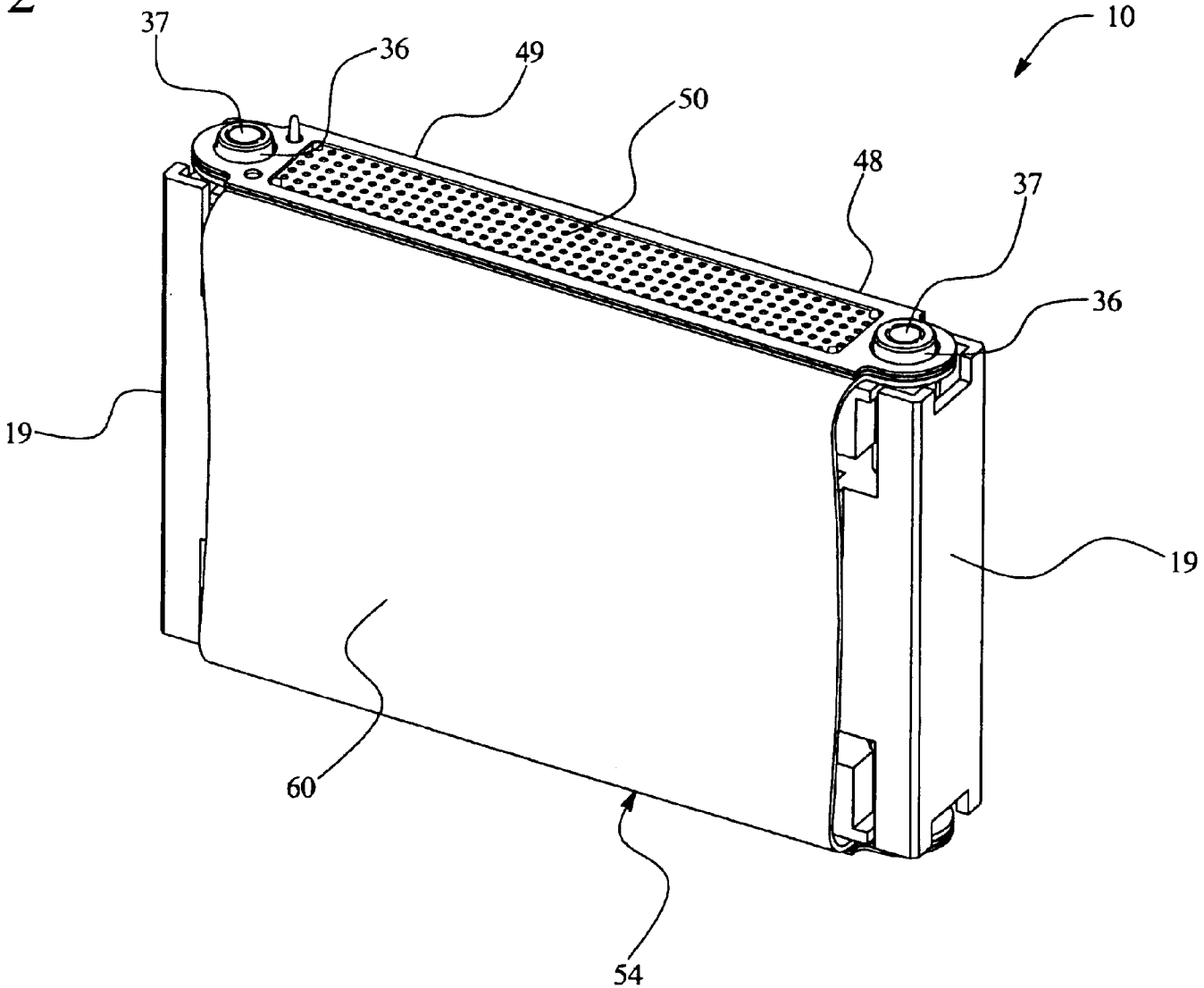
FIG. 2 illustrates an isometric view of a flex connector assembly formed in accordance with an embodiment of the present invention.

FIG. 2 illustrates an isometric view of a flex connector assembly 10 formed in accordance with an embodiment of the present invention. FIG. 2 shows the flex connector assembly 10 fully assembled.

Figure 3:
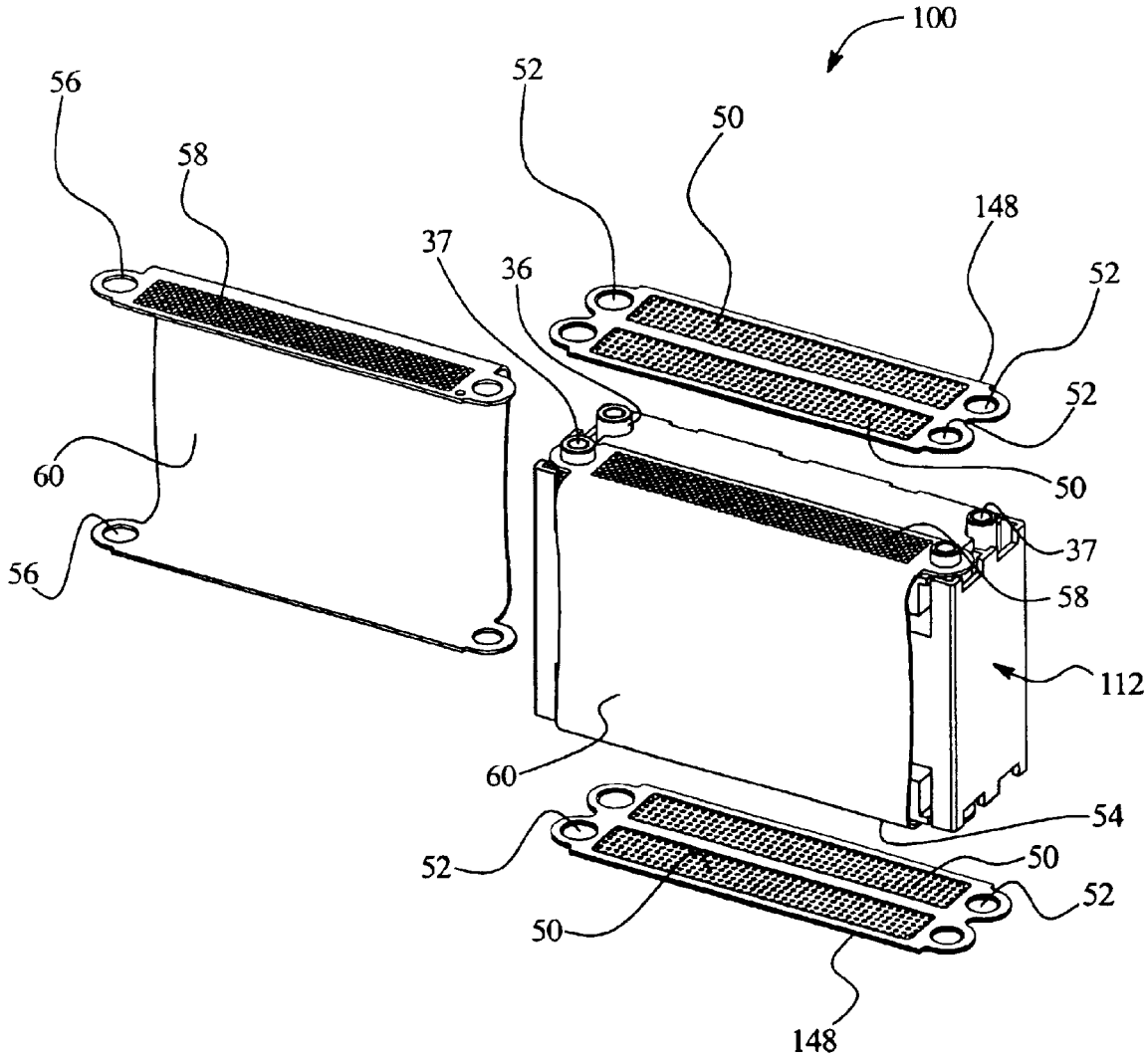
FIG. 3 illustrates a partially exploded view of a double flex connector assembly formed in accordance with an embodiment of the present invention.
Figure 4:
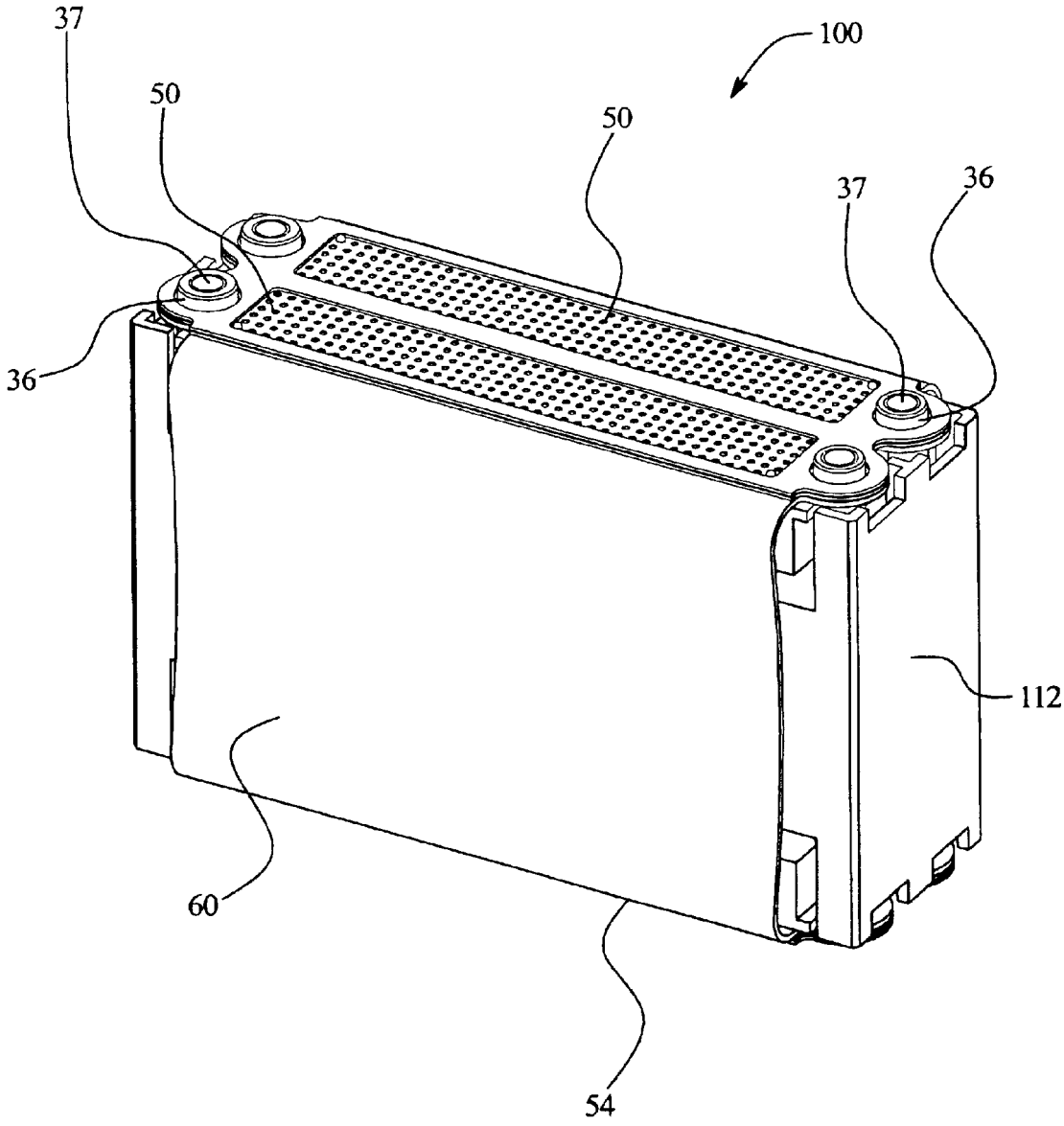
FIG. 4 illustrates an isometric view of a double flex connector assembly formed in accordance with an embodiment of the present invention.

FIG. 3 illustrates a partially exploded view of a double flex connector assembly 100 formed in accordance with an embodiment of the present invention. FIG. 4 illustrates an isometric view of a double flex connector assembly 100 formed in accordance with an embodiment of the present invention. The double flex connector assembly includes a housing 112 and a dual compressible socket 148. As shown in FIGS. 3 and 4, one flex circuit 54 wraps around one side of the housing 112, while another flex circuit 54 wraps around another side of the housing 112. The double flex connector assembly 100 may be used when additional contact between printed circuit boards is needed. For example, if a conductive array 58 of the flex circuit 54 includes 240 contacts, a printed circuit board may need 480 points of contact. Thus, two flex circuits 54 may be utilized to accommodate the contact requirements.

Figure 5:
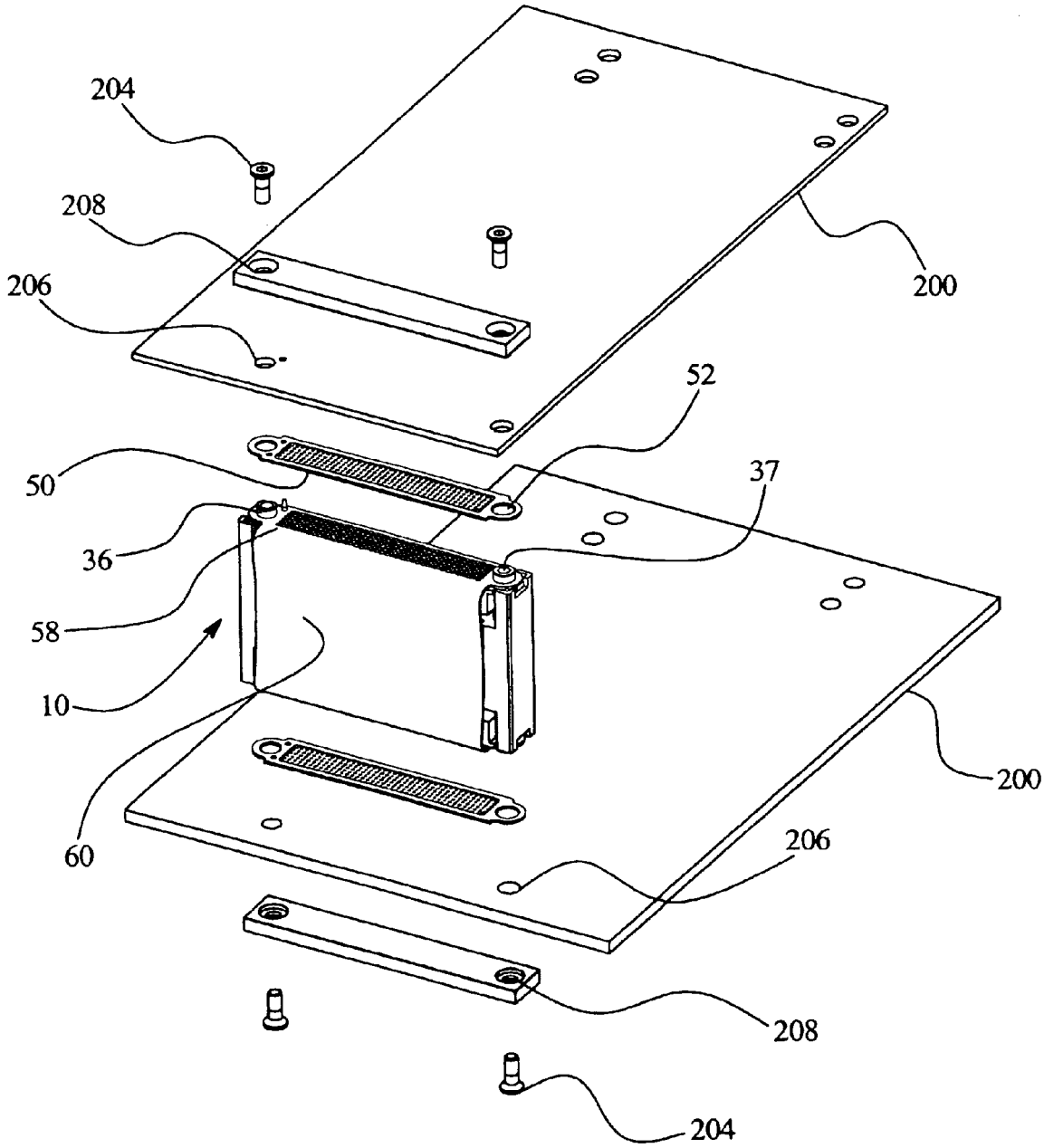
FIG. 5 illustrates a partially exploded view of two printed circuit boards in relation to a flex connector assembly formed in accordance with an embodiment of the present invention.
Figure 6:
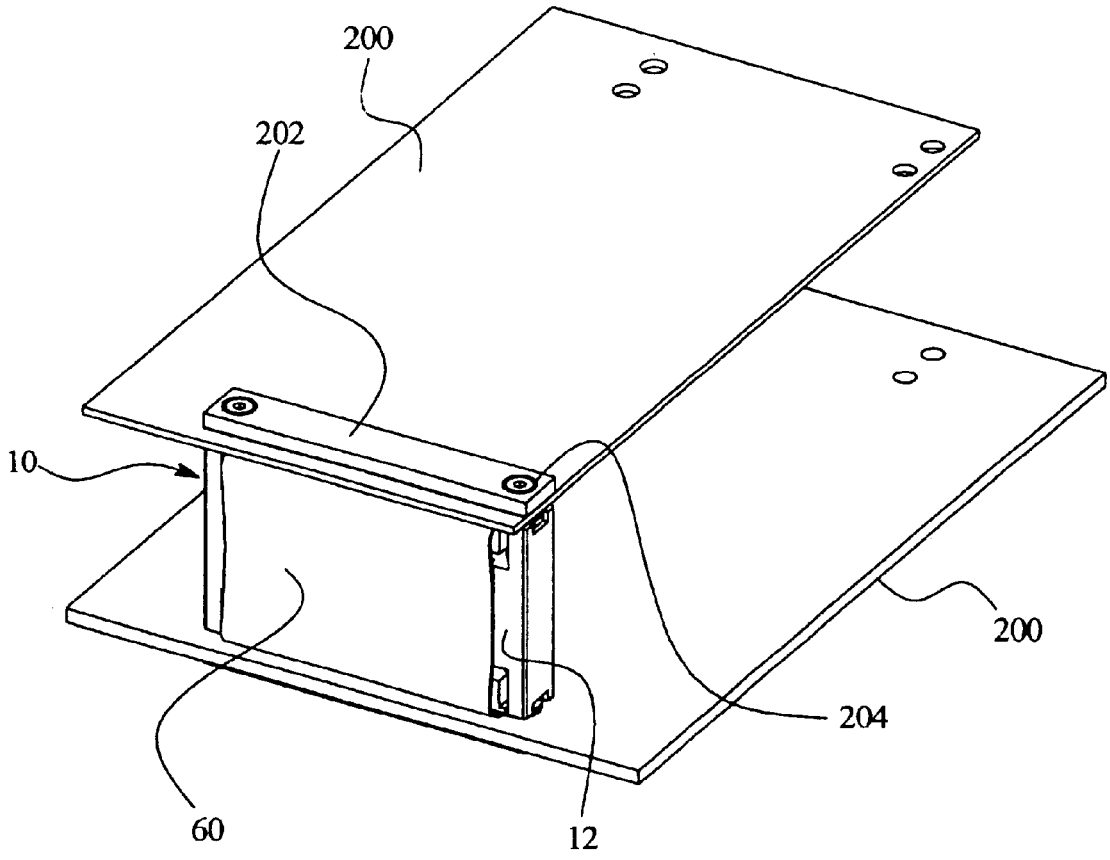
FIG. 6 illustrates an isometric view of two printed circuit boards connected through a flex connector assembly.

FIG. 5 illustrates a partially exploded view of two printed circuit boards 200 in relation to a flex connector assembly 10 formed in accordance with an embodiment of the present invention. FIG. 6 illustrates an isometric view of two printed circuit boards 200 connected through a flex connector assembly 10. Each printed circuit board 200 includes fastener through-holes 206 that align with the location pins 36. An insulated bolster plate, having fastener through-holes 208 is positioned over (or under) each printed circuit board 200, such that the fastener through-holes 206 of the printed circuit boards 200 align with the fastener through-holes 208 of the bolster plates. The printed circuit boards 200 sandwich the flex connector assembly 10. Electrical contacts (not shown), such as Land Grid Array (LGA) pads, located on a printed circuit board 200 contact the conductive array 50 on a compressible socket 48. In order to compress the circuit boards 200 into the compressible sockets 48, and consequently the flex circuit 54, fasteners 204, such as flat head screws, are inserted into the fastener through-holes 208 and 206, such that the fasteners 204 are retained by the fastener retention cavities 37 of the location pins 36. The fasteners 204 are fastened into the fastener retention cavities 37, such as by screwing the fasteners 204 into the fastener retention cavities 37, until the desired amount of compression is achieved. Because the flex connector assembly 10 is preloaded due to the inclusion of the springs 34 within the flex connector assembly 10, a relatively small amount of compressive force is used to fasten the printed circuit board 200 to the flex connector assembly 10 through the fasteners 204. That is, the springs 34, as discussed above, exert outwardly-directed forces (denoted by reference lines A and B) that act to push the conductive arrays 50 into the electrical contacts of the printed circuit boards 200.

As the components of the flex connector assembly 10 are compressed together, an electrical path is established from one printed circuit board 200 to the other printed circuit board 200. For example, an electrical signal may pass from electrical contacts on one printed circuit board 200 to the conductive array 50 of a first compressible socket 48. The electrical signal then may pass from the conductive array 50 of the first compressible socket 48 to a first conductive array 58 of the flex circuit 54. The electrical signal may then pass from the first conductive array 58 to traces on or within the flex circuit 54, at which point the electrical signal passes from the traces to the second conductive array 58 of the flex circuit 54. Then, the electrical signal may pass from the second conductive array 58 of the flex circuit 54 to the second compressible socket 48. Because the second compressible socket 48 is compressed against electrical contacts on the second printed circuit board 200, the electrical signal may then pass from the second compressible socket 48 to the second printed circuit board 200. The electrical path from the first printed circuit board 200 to the second printed circuit board 200 travels around the flex connector assembly 10, as opposed to through the flex connector assembly. That is, instead of traveling through the springs 34 and location pins 36, the electrical signals travel over and through the main body of the flex circuit 54 (as opposed to the components that the flex circuit 54 covers). While FIGS. 5 and 6 show two printed circuit boards 200 connected through the flex connector assembly 10, the flex connector assembly 100 connects two printed circuit boards in a similar fashion.

Figure 7:
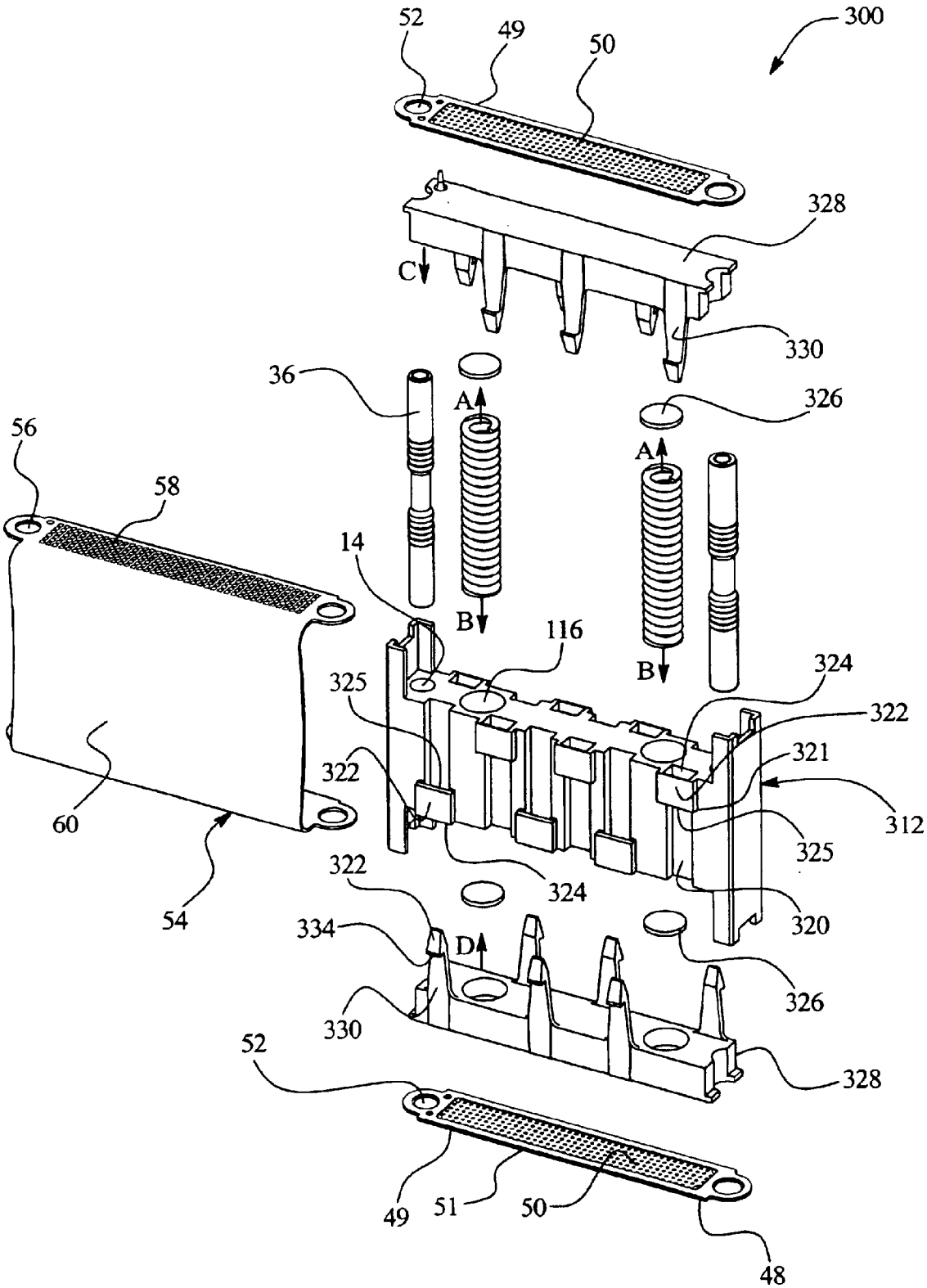
FIG. 7 illustrates an exploded view of a flex connector assembly formed in accordance with an embodiment of the present invention.

FIG. 7 illustrates an exploded view of a flex connector assembly 300 formed in accordance with an embodiment of the present invention. The flex connector assembly 300 includes support member 328, housing 312 and spring caps 326. The housing 312 includes support leg retaining features 321. Each support leg retaining feature 321 includes a channel 320 and an engagement member reception passage 324 having an engagement edge 325. Each spring cap 326 is positioned within a cavity 327 of the support member 328. The connector assembly 300 is assembled and functions similar to the connector assembly 10.

Each support member 328 includes support legs 330 configured to be received and retained by support leg retaining features 321. Each support leg 330 includes an engagement member 332 having a ramped surface and an engagement edge 334. Each engagement member 332 is configured to be received within an engagement member reception passage 324 formed on or within the housing 312. As the engagement member 332 passes through the engagement member reception passage 324, the support leg 330, and therefore the engagement member 332, is slidably received and retained within the channel 320. As the engagement member 332 passes through the engagement member reception passage 324, the engagement edge 334 of the engagement member 332 contacts and latches, hooks, or otherwise catches the edge 325 of the engagement member reception passage 324. In this way, the housing 312 may retain the support member 328.

Thus, embodiments of the present invention provide for a board-to-board connector that is capable of connecting printed circuit boards with sufficient clearance between the printed circuit boards, while maintaining reasonably high frequency transmission between the two printed circuit boards. Embodiments of the present invention provide a board-to-board flex connector that may span larger distances than previous board-to-board flex connectors. The greater distance between circuit boards allows for larger components to be positioned on and between the circuit boards.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A flex connector assembly for connecting circuit boards, comprising:

a housing having opposite top and bottom surfaces and at least one cavity extending from said top surface to said bottom surface;

a biasing element located within said cavity along an axis, said biasing element configured to exert an axial force substantially parallel to said axis and directed from an interior of said cavity toward said top surface and said bottom surface;

at least one pressure support member extending over one of said top and bottom surfaces, said pressure support member exerting an axial force on said biasing element directed from an exterior of said cavity toward one of said top and bottom surfaces;

at least one flex circuit having a flex array extending over said pressure support member; and at least one compressible socket having a socket array overlapping said at least one flex circuit, said biasing element urging said flex array and said socket array onto one another.

2. The flex connector assembly of claim 1, further comprising a first printed circuit board having electrical contacts compressed into said socket array.

3. The flex connector assembly of claim 1, wherein:

said at least one compressible socket includes first and second compressible sockets corresponding to said top and bottom surfaces;

said flex array includes a first flex array and a second flex array corresponding to said first and second compressible sockets, respectively; and said first and second socket arrays being configured to be compressed into electrical contacts of first and second printed circuit boards, respectively.

4. The flex connector assembly of claim 1 further including at least one location pin extending outwardly from said housing, said at least one location pin having a fastener retention cavity that retains a fastener, said fastener acting to compress said biasing element along said axis when a printed circuit board is coupled to said compressible socket.

5. The flex connector assembly of claim 1 wherein said flex circuit includes a main body, a first flex array and a second flex array, said first and second flex arrays being located proximate said top and bottom surfaces of said main body, said flex circuit wrapping around said housing and said at least one pressure support member such that said first flex array is engaged to a first socket array and said second flex array is engaged to a second socket array.

6. The flex connector assembly of claim 1, wherein said flex connector assembly provides an electrical connection between two printed circuit boards.

7. The flex connector assembly of claim 1, wherein said at least one flex circuit includes two flex circuits.

8. The flex connector assembly of claim 1, wherein said pressure support member includes a pressure plate and a support plate, said pressure plate retaining a terminal end of said biasing element, and said support plate having support legs that are retained by support leg retaining features on said housing.

9. The flex connector assembly of claim 8, wherein said support leg retaining features include ramped surfaces and retaining edges.

10. A system for connecting two circuit boards, comprising:

a first circuit board having a first set of electrical contacts;

a second circuit board having a second set of electrical contacts; and a board-to-board flex connector comprising:

a housing having a top surface, a bottom surface and at least one longitudinally extending cavity extending between said top surface and said bottom surface;

a preloaded spring in said cavity, said spring exerting a longitudinal force through said top and bottom surfaces of said housing;

at least one pressure support member located at one of said top and bottom surfaces, said pressure support member exerting a longitudinal force on said preloaded spring;

at least one flex circuit having a flex array arranged on one of said top and bottom surfaces; and at least one compressible socket having a socket array overlapping said at least one flex circuit, said preloaded spring engaging said flex array and said socket array to one another.

11. The system of claim 10, wherein:

said at least one compressible socket includes first and second compressible sockets corresponding to said top and bottom surfaces;

said flex array includes a first flex array and a second flex array corresponding to said first and second compressible sockets, respectively; and said first and second socket arrays are configured to be compressed into electrical contacts of first and second printed circuit boards, respectively.

12. The system of claim 10, wherein said pressure support member includes a pressure plate and a support plate, said pressure plate retaining a terminal end of said spring, and said support plate having support legs that are retained by support leg retaining features on said housing.

13. The flex connector assembly of claim 10 wherein said board-to-board flex connector further comprises two location pins extending outwardly from said board-to-board flex connector, said location pins having fastener retention cavities, each of said fastener retention cavities retaining a fastener, said fasteners compressing said spring when said first and second printed circuit boards are coupled to said board-to-board flex connector.

14. The flex connector assembly of claim 10, wherein said at least one flex circuit includes two flex circuits.

15. The system of claim 10, wherein said first and second pressure support members each includes a pressure plate and a support plate, said pressure plate retaining terminal ends of said springs, and said support plate having support legs that are retained by support leg retaining features on said housing.

16. The flex connector assembly of claim 15, wherein said support leg retaining features include ramped surfaces and retaining edges.

17. A flex connector assembly, comprising:

a housing having two longitudinal cavities therein extending between opposite first and second ends of said housing;

a preloaded spring in each of said longitudinal cavities, each of said springs configured to exert a longitudinal force from said first and second ends of said housing;

a first pressure support member located on said first end of said housing, and a second pressure support member located on said second end of said housing, said first and second pressure support members mounted on said first and second ends resisting said longitudinal force;

first and second compressible sockets arranged proximate said first and second ends, said first compressible socket having a first socket array and said second compressible socket having a second socket array; and at least one flex circuit having a main body, a first flex array located at one end of said main body and a second flex array located at another end of said main body, said first and second flex arrays being electrically connected through traces located on said flex circuit, said longitudinal force engaging said first flex array into contact with said first socket array to form an electrical path therebetween, said longitudinal force engaging said second flex array into contact with said second socket array to form an electrical path therebetween, said first socket array being configured to be compressed into contacts on a first circuit board, and said second socket array being configured to be compressed into contacts on a second printed circuit board.

18. The flex connector assembly of claim 17 further comprising two locating pins extending outwardly from said housing, said locating pins having fastener retention cavities, each of said fastener retention cavities retaining a fastener configured to compress first and second circuit boards in toward said housing.

19. The system of claim 17, wherein said first and second pressure support members each includes a pressure plate and a support plate, said pressure plate retaining terminal ends of said springs, and said support plate having support legs that are retained by support leg retaining features on said housing.

20. The flex connector assembly of claim 19, wherein said support leg retaining features include ramped surfaces and retaining edges.

21. A connector for connecting a first circuit board and a second circuit board, said connector comprising:

a housing having a first end surface, a second end surface opposite said first end surface, and a cavity axially extending between said first and second end surfaces;

a bias element situated within said cavity;

a support plate retained to said housing and extending over one of said first end second end surfaces, said support plate contacting said bias element and loading said bias element within said cavity when said support plate is retained to said housing, thereby producing an axial biasing force on said support plate;

at least one flex circuit having a flex array disposed over said support plate such that said support plate is positioned between said housing and said flex circuit; and at least one socket disposed over said flex circuit such that said flex circuit is positioned between said support plate and said socket, said socket having a socket array overlapping said flex circuit, said socket positionable along said axis to further load said bias element as said socket is engaged to one of the circuit boards.

22. A connector in accordance with claim 21 further comprising a pressure plate positioned between said bias element and said support plate.

23. A connector in accordance with claim 21 further comprising a location pin extending through said housing for locating said connector with respect to the first and second circuit boards.

24. A connector for connecting a first circuit board and a second circuit board, said connector comprising:

a housing having a first end surface, a second end surface opposite said first end surface, and a pair of cavities axially extending between said first and second end surfaces and approximately parallel to one another;

a pair of spring elements, each of said spring elements situated in a respective one of said cavities;

a pair of support plates retained to said housing, each of said pair of support plates extending over one of said first end second end surfaces, said support plates contacting said spring elements and compressing said spring elements within said cavities, thereby producing an axial biasing force on each of said pair of support plates;

a flex circuit mounted to said body, said flex circuit having a body and first and second flex arrays extending from opposite ends of said body, said first and second flex arrays disposed over a respective one of said first and second support plates; and a pair of sockets mounted to said flex circuit, each of said sockets disposed over a respective one of said first and second flex arrays and each of said sockets including a socket array overlapping said flex circuit;

wherein said sockets are movable relative to said housing to further compress said spring elements within said cavities when the connector is positioned between the first and second circuit boards, thereby ensuring a normal contact force between said sockets and the first and second circuit boards.

25. A connector in accordance with claim 24 further comprising a pair of location pins extending through said housing proximate said spring elements, said location pins configured to be secured to the first and second circuit boards with a fastener.

26. A connector in accordance with claim 25 further comprising a first fastener extending though the first circuit board and engaging one end of a location pin, and a second fastener extending through the second board and engaging a second end of said location pin, said fasteners compressing said pair of spring elements as said fasteners are secured to said location pin.

27. A connector for connecting a first printed circuit board and a second printed circuit board, said connector comprising:

a housing having a first end surface, a second end surface opposite said first end surface, and at least one cavity extending between said first and second end surfaces along an axis substantially perpendicular to said first end surface and said second end surface;

a bias element situated within said at least one cavity and having opposite ends;

a pair of support plates retained to said housing, each of said support plates extending over a respective one of said first and second end surfaces, each of said support plates contacting a respective one of said ends of said bias element and compressing said bias element therebetween, thereby producing an axial biasing force on each of said support plates substantially parallel to said axis;

at least one flex circuit having a first flex array and an second flex array electrically connected thereto, said flex circuit coupled to said support plate, each of said support plates being positioned between said housing and a respective one of said flex arrays; and a pair of sockets, each of said sockets coupled to a respective one of said pair of support plates wherein said first and second flex arrays are positioned between a respective one of said support plates and a respective one of said sockets, each of said pair of sockets having a socket array overlapping a respective one of said flex arrays, said sockets depressible relative to said housing to further compress said bias elements when said connector is coupled between said circuit boards.

* * * * *